United States Patent [19]

Arendt et al.

[11] 4,259,903

[45] Apr. 7, 1981

[54] CIRCUIT ARRANGEMENT FOR SYNCHRONIZING THE TIMES OF OCCURRENCE OF THE PRINT HAMMER IMPACT WITH THE ARRIVAL OF THE PRINT TYPE AT THE PRINT POSITION

[75] Inventors: Klaus Arendt, Holzgerlingen; Werner Hasler, Schönaich; Karl-Heinz Schaller, Herrenberg, all of Fed. Rep. of Germany

[73] Assignee: International Business Machines Corporation, Armonk, N.Y.

[21] Appl. No.: 95,808

[22] Filed: Nov. 19, 1979

[30] Foreign Application Priority Data

Oct. 11, 1978 [DE] Fed. Rep. of Germany ..... 2338074
Oct. 11, 1978 [DE] Fed. Rep. of Germany ..... 2360323
Oct. 11, 1978 [DE] Fed. Rep. of Germany ..... 2848786

[51] Int. Cl.[3] ..... B41J 7/92

[52] U.S. Cl. ..... 101/93.03; 101/93.29; 307/498; 361/169

[58] Field of Search ..... 101/93 R, 93.03, 93.15, 101/93.16, 93.17, 93.18, 93.19, 93.28, 93.29, 93.32; 324/224; 361/139, 140, 152, 161, 166, 168, 169; 318/634, 637; 340/659-663; 307/229-230, 234, 265-268, 401, 407, 417

[56] References Cited

U.S. PATENT DOCUMENTS

| | | | |
|---|---|---|---|
| 3,712,212 | 1/1973 | Beery | 101/93.03 |
| 4,027,761 | 6/1977 | Quaif | 361/169 X |
| 4,083,299 | 4/1978 | Norton | 101/93.03 |
| 4,103,617 | 8/1978 | O'Brien et al. | 101/93.03 |
| 4,149,120 | 4/1979 | Richter | 307/229 X |
| 4,156,283 | 5/1979 | Gilbert | 307/229 X |
| 4,162,131 | 7/1979 | Carson, Jr., et al. | 101/93.03 X |
| 4,189,246 | 2/1980 | Kane et al. | 101/93.03 X |
| 4,192,230 | 3/1980 | Blom et al. | 101/93.03 |
| 4,200,843 | 4/1980 | Egami et al. | 307/230 |

FOREIGN PATENT DOCUMENTS

| | | | |
|---|---|---|---|
| 1932560 | 1/1970 | Fed. Rep. of Germany | 101/93.03 |
| 2338074 | 2/1974 | Fed. Rep. of Germany | 101/93.03 |
| 2353825 | 5/1974 | Fed. Rep. of Germany | 101/93.03 |
| 2360323 | 7/1974 | Fed. Rep. of Germany | 101/93.03 |

OTHER PUBLICATIONS

"Programmed Amplitude Print Hammer Driver Circuit", IBM Tech. Discl. Bulletin, vol. 22, No. 4, Sep. 1979, pp. 1540-1541.

"Impact Force Compensation for Voltage Variations in the Hammer Firing Pulse in Impact Printer", IBM Tech. Discl. Bulletin, vol. 22, No. 5, Oct. 1979, pp. 1756-1758.

"Constant Energy Driver", IBM Tech. Discl. Bulletin, vol. 22, No. 3, Aug. 1979, pp. 968-969.

"Controller for Electromechanical Printhammer", IBM Tech. Discl. Bulletin, vol. 22, No. 8A, Jan. 1980, pp. 3294-3295.

*Primary Examiner*—E. H. Eickholt
*Attorney, Agent, or Firm*—John S. Gasper

[57] ABSTRACT

From the variables print hammer magnet voltage, print hammer magnet temperature, impact force, and a value derivable from the actual print time, a control voltage, which correspondingly delays an early trigger pulse by means of a variable delay element, is determined in an "open" control loop. The variables are analogously combined by adding, subtracting, and multiplying the analogue values, and by subsequently forming a weighted sum.

12 Claims, 8 Drawing Figures

SPACE-TIME-TRAJECTORIES OF TYPE AND HAMMER (CHARACTER)

(CONDITION: ACCURATE ALIGNMENT)

SPACE-TIME-TRAJECTORIES OF TYPE AND HAMMER (CHARACTER)

(CONDITION: ACCURATE ALIGNMENT)

(CONTROL VOLTAGE) $V_S$
24
+5,2 V
R137
26
R 132
43
R 128
R 129
R 130
R 131
R 134
$V_{SS}$
(2) $V_T$
(2) $V_V$
(2) $V_{TV}$
(2) $V_T$
21
R153
R 133
42
R155
R 156
R154
+5,2 V
C105
41
40a
+ NOT PRINT TIME
(4)
22
+5,2 V
+5,2 V

CIRCUIT ARRANGEMENT FOR SYNCHRONIZING THE TIMES OF OCCURRENCE OF THE PRINT HAMMER IMPACT WITH THE ARRIVAL OF THE PRINT TYPE AT THE PRINT POSITION

DESCRIPTION

1 Field of Invention

The invention concerns a circuit arrangement for synchronizing the impact time of print hammers in an on-the-fly type printer, in particular line printers, with the time of occurrence of a print type to be printed at the desired print position, with means for respectively detecting and determining deviations of operating parameters, such as, for example, the supply voltage and the temperature of the print hammer magnets.

2 Prior Art

For printers with rotating print type carriers, such as, for example, print chains, print drums, print belts, and the like, which pass type impact positions or print positions at high speed, it is essential to accurately determine and adhere to the time of print. For this purpose it is essential to operate the print mechanism, for example, a print hammer in such a manner that it impacts the character type to be printed at the very time when said print hammer and said character type are in full alignment. This applies in each case, irrespective of whether the character spacing on the type carrier is uniform or not. To this end, the print time has to be strictly adhered to down to about 40 microseconds, in order to generate a print at the correct position, i.e., in order to avoid that parts of a character are not printed. During this, the time, duration, and energy of the impact primarily determine the quality of print and the print image, respectively.

From the Deutsche Offenlegungsschrift No. 19 32 560 a control circuit for high-speed printers is known, by means of which synchronizing errors between the position of the character type and the actuation of the print hammer are dynamically compensated in that as a function of the speed of the type carrier movement, the temperatures occurring at the different points of the circuit, and the voltage applied to the individual print hammer magnets, error signals are generated in the case of deviations from predetermined values, said signals being combined in a merge stage to form a compensated control voltage. This means, however, that deviations of the supply voltage, the speed of the type carrier, and the temperature, by being compared with desired values, lead to error signals which, in turn, by being compared with a saw-tooth voltage, control in a voltage compare circuit the time at which the control signal for the print hammer is to be triggered. The outlay this involves is very high.

From the Deutsche Auslegeschrift No. 23 38 074 a compensation method is known, by means of which at the time of print hammer energization for the purpose of printing a character, the extent of reduction in the voltage for the control of the print magnets is predetermined as a function of the number of characters to be printed before or after said character, on the basis of which the compensation time is subsequently determined. To this end, the lower voltage, which would result from the number of concurrently energized print hammer magnets, rather than the actual voltage, is used. This number is derived from a counter.

From the Deutsche Offenlegungsschrift No. 23 60 323 a control of the impact force in type printers is known by means of which the duration and the time of occurrence of the control pulses actuating the print hammer magnets are dynamically controllable.

All of these approaches have certain disadvantages. If one used for anticipatory control purposes the load expected to be imposed on the power supply of the print hammer magnets, said load being derived from the number of print hammer magnets actuated approximately simultaneously, then such an approach would afford but an inaccurate control. A comparison of the actual values of three parameters with the desired values for detecting an error signal would not be satisfactory either.

In actual fact, matters are much more complicated, and for a long time it did not seem to be possible to compensate all parameter deviations at reasonable cost. The print quality i.e., the accurate synchronization of the impact time of the print hammer and the print type at the print position, is influenced by quite a number of partly independent, variable parameters, of which only the most important will be described briefly below. Apart from the constancy and rigidity of the controlled voltage source with regard to line voltage fluctuations, the load imposed by the actuation of up to eight print hammer magnets affects the voltage available at each actuated print hammer. Equally of influence is not only the changing ambient temperature but also the heating up of the current carrying print hammer magnets.

The speed of the print type carrier as such is determined by a synchronous motor and thus is initially dependent upon the frequency constancy of the mains. Actuation of one or several print hammers decelerates the belt each time to a higher or lower degree, so that it has to be reaccelerated.

The permeability of the cores of the print hammer magnets is not only similarly temperature dependent but may deviate within admissible manufacturing tolerances. The same holds for the print type carrier. In addition, humidity and atmospheric pressure exert an influence.

In this connection further factors to be considered are temperature changes of the hammer magnet coils and thus resistance changes resulting from the temperature coefficient of the coil, as well as different thermal influences exerted on the print type carrier, i.e., the print belt used in this case, as compared to the frame carrying the print hammer magnets.

To consider in a simple manner such and still further parameter in connection with a compensating circuit, appeared to be an almost unsolvable task, in particular in connection with a closed loop control circuit in accordance with the prior art.

Attempts have already been made to mechanically decouple the print hammer from the armature of the print hammer magnet by means of an interposer. It has also been attempted to control the print hammer magnets by means of constant current. It is known further to compensate the positive temperature coefficient of the coil of each print hammer magnet by means of a network with negative temperature coefficients. However, these solutions, too, require extensive means, as they have to be provided for each print position. This, in turn, leads to the energy converted into heat being substantially increased, and more energy than necessary being used.

SUMMARY OF THE INVENTION

Therefore, it is to be attempted to provide a control path for the dynamic correction of the print hammer flight time for an accurate alignment of print hammer and print type in the "print window" at impact time, simultaneously adjusting the impact force as a function of the thickness of the paper and the number of originals or copies to be made. Instead of an exact solution which is practically impossible, a compromise is to be struck which meets all requirements in a very satisfactory manner. In accordance with the invention, this is achieved in that in a circuit arrangement of the type previously described the values thus determined are combined with a dynamic value, exponentially dependent upon time, in accordance with the relation $$\Delta DLY = -K_1\Delta T + K_2\Delta T \cdot \Delta V + K_3\Delta V - K_6\Delta A$$

where $\Delta T$ is the temperature of the print hammer magnets $\Delta V$ is the voltage of the print hammer magnets $\Delta A$ is a value dependent upon the print activity, which is determined by the discharging effected in the periods in which there is no printing and by the charging of a charge storage effected during printing, and $K_1$, $K_2$, $K_3$, and $K_6$ are device specific coefficients and that the control voltage ($\Delta DLY$) thus determined serves as a control voltage for a voltage-controlled delay element interconnected between the trigger pulse generator and the print hammer control logic.

Preferably, the arrangement is substantially improved in that for the additional detection of the number of copies to be made and for the determination of the impression force required therefor, the parameters determined are combined in accordance with the relation $$\Delta DLY = -K_1\Delta T + K_2\Delta T \cdot \Delta V + L_3\Delta V + K_4\Delta I + K_5 \cdot \Delta V \cdot \Delta I + K_6\Delta A$$

where $\Delta I$ is the impact force.

DESCRIPTION OF THE DRAWING

The invention will be described in detail below by way of an embodiment with reference to the accompanying drawings in which.

DETAILED DESCRIPTION OF THE INVENTION

Figure 1:
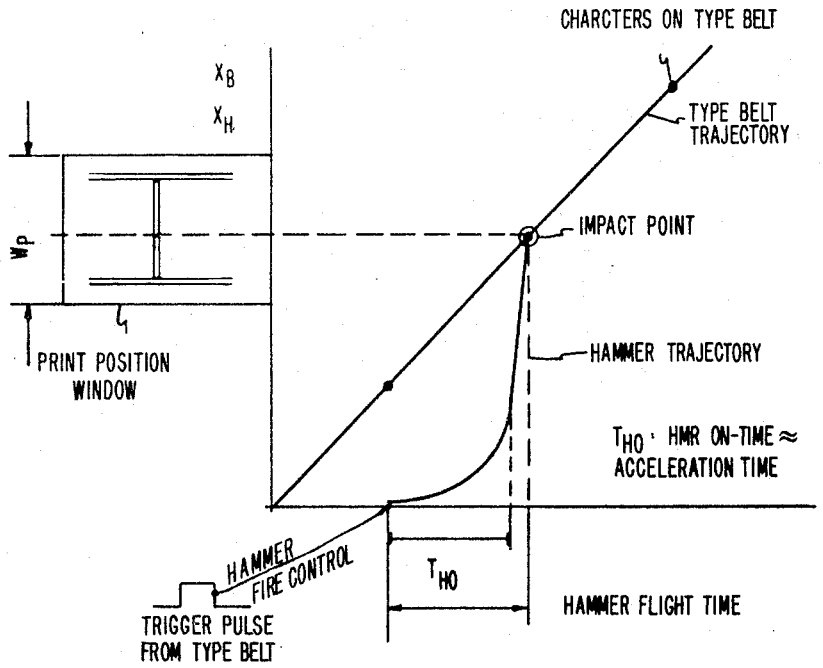
FIG. 1 is a diagram explaining the problem posed.

FIG. 1 is a purely schematic view of the path of the type belt versus time, the individual types being shown equidistantly in this case, although such an arrangement is not absolutely necessary. Also shown is a print position with the so-called print window WP, i.e., the position at which at a particular time the print type arranged on the type belt and the print hammer impacting the type belt must coincide. Up to that point, the print hammer during its flight has covered a particular distance in a particular time. The trigger pulse is shown purely schematically. This pulse is sensed at the type belt. Also recognizable is the trigger time for the print hammer and the switching time THO of the print hammer magnets which roughly coincides with the acceleration time. Accurate printing of the character to be printed is dependent upon the accurate alignment of the impact point of the print hammer relative to the print type arranged on the type belt, or, in other words, the synchronization in time of the point of impact of the print hammer and the time of occurrence of the print type to be printed in the print position. It is pointed out in this connection that the width WP of the print window is about 2.54 mm and that the speed of the type belt is about 2.8 m per second. On the basis of these values there is computed the maximum deviation in time of about 60 microseconds, which is permissible without individual parts of a character to be printed being cut off.

As described in the introduction to the specification, a great number of parameters influence to a higher or lower degree the accurate synchronization of the print hammer and print type during printing. It has been found, however, that, proceeding from particular simplifying assumptions, this complicated problem can be solved in a surprisingly simple manner.

Figure 2:
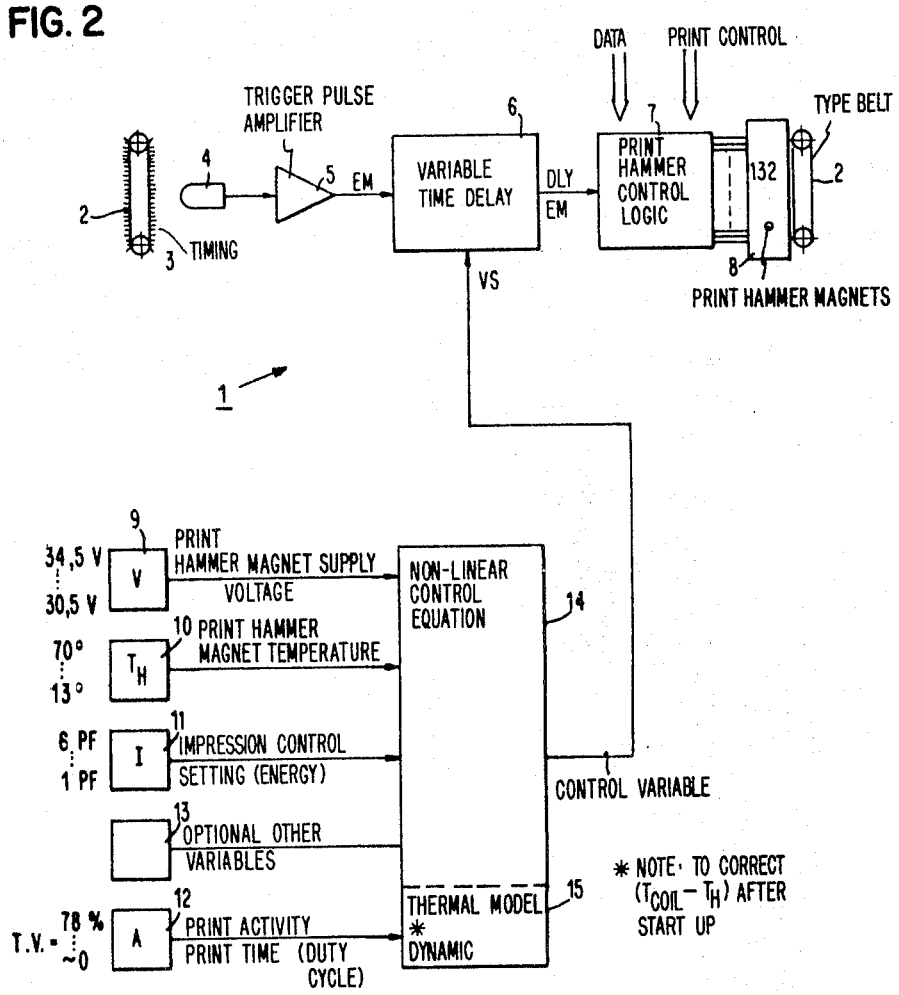
FIG. 2 is a simplified basic circuit diagram of the invention.

This will be described in detail below by means of the basic circuit diagram of FIG. 2. FIG. 2 shows purely schematically the essential parts of a type printer 1 with a print type belt 2 which in this case is a metal belt out of which the individual print types are etched. On the type belt there are the marks 3 serving as position information for the timer. These marks are sensed by a sense element 4. For the purpose of emitting a timing pulse, this sense element is adjustable relative to the marks to be sensed. In the present case, magnetically sensed marks and a magnetic sense element are provided. The timing pulses, which are sensed by the sense element 4 and which are also referred to as trigger pulses, are fed to a trigger pulse amplifier 5, the output signals of which can be applied uncompensated to a print hammer logic 7 to which the data and the print control signals are transferred and which subsequently, in accordance with the information to be printed, causes the type belt 2 to be impacted by means of the 132 print hammer magnets 8, thus generating a print on a record carrier. For the purpose of the invention, a variable time delay 6 is provided which is controlled by a control signal VS. A voltage source 9 for the print hammer magnets is shown purely schematically. This voltage source supplies the print hammer supply voltage which, depending upon the load imposed by the number of actuated print hammers, may vary between 34.5 V and 30.5 V. Also provided is a temperature sensor 10 sensing the temperature at the hammer magnets, which in the present example, may range from about 13° to 70° C. Also provided are sense means for the impact force i.e. sense element 11, which can be adjusted to different form widths or to the number of copies required, as indicated, for example, by the numbers 1–6. Finally, there is a pick-up for the print activity 12, which indicates the print time actually used and the duty cycle. A further parameter sensor or pick-up 13 is indicated, to show that still further variables can be sensed and processed.

It is initially pointed out that all of these sense elements or pick-ups are capable of supplying absolute values, but that for practical reasons, difference values, i.e., only deviations from a presettable voltage, deviations from a predetermined temperature, deviations from the impact force for a layer of paper without copies, and deviations from an assumed average print activity are used for control purposes. The voltage values sensed by the sense elements 9 and 10 are fed to a non-linear circuit, by means of which said vaues are combined in accordance with a non-linear equation.

Particularly important in this connection is that the print activity is dynamically processed in a circuit 15 representing a thermal model. This will be explained in detail below. Assuming that no copies are to be made, these three values already permit an accurate synchronization of the impact time of the print hammer and of the time of occurrence of the print type at the print position. The simple equation applicable in this case is $$\Delta DLY = -K_1\Delta T + K_2\Delta T\cdot\Delta V + K_3\Delta V - K_6\Delta A \quad (1)$$

where $\Delta A$ is a value dependent upon the print activity, which is determined by the discharging effected in the periods in which there is no printing and by the charging of a charge storage effected during printing.

If several copies are to be printed, the impact force, i.e., the setting to more than one copy and the impact energy required for this purpose, is quite important. In this case a signal $\Delta A$ is processed which is based on a setting effected in a further stage of the circuit 14, whereby the non-linear control equation reads as follows $$\Delta DLY = -K_1\Delta T + K_2\Delta T\cdot\Delta V + K_{3'\Delta V} + K_4\Delta I + K_5\cdot\Delta V\cdot\Delta I - K_6\Delta A \quad (2).$$

This shows that $\Delta I$ enters the weighted sum both directly and after multiplication by $\Delta V$.

As may be seen more clearly from FIG. 3, the various factors necessary for determining the control voltage are processed in the following manner. The setting for the impact force of sense element 11, which in this case takes the form of an open and a closed switch, is fed as a digital two-bit signal to the impression force control 16 on the one hand and to the form thickness sense circuit 19 on the other. A timing pulse for the impact control is applied to the impression force control 16 which emits a signal depending upon the impact force at sense element 11. This signal changes the width of the pulse applied to the print control. If only one copy is to be made, i.e., if no further copies are required, the pulse applied to the impact control is not changed in its width.

In principle, it is possible for a control to individually sense and combine the supply voltage at each print magnet. However, such an approach is impracticable for many, in particular cost, reasons. In the present case, the difference $\Delta V$ relative to a rated voltage is sensed on a current bus supplying the voltage for all print hammer magnets; it would, of course, also be possible to use only the momentous value of this voltage for such a purpose. This voltage is fed to a voltage sense amplifier 17.

The temperature and the temperature difference $\Delta T$, respectively, is determined in the same manner. In principle, the temperature could also be measured at each individual print hammer magnet, i.e., at its magnet coil. It is readily apparent that such an approach would entail a considerable outlay. Therefore, joint temperature sense means are provided for the various print hammer magnets. These means are designed in such a manner that a temperature sense bar, whose temperature can be measured in the usual manner, is arranged immediately adjacent to the row of the various print hammer magnets. However, this leads to an average value which is a function of the temperature of the print hammer magnet coils. This measuring value is fed to a temperature sense amplifier 18. To this amplifier a temperature control 25 is connected, by means of which a reference value for the reference temperature can be set as a function of a reference voltage $V_{REF}$. The output signals of the voltage sense amplifier 17 and the temperature sense amplifier 18 are fed to an analogue multiplier circuit in which the values $\Delta V$ and $\Delta T$ are multiplied by each other, being emitted as signal $\Delta V\cdot\Delta T$ on the output side. In addition, the output signals of the voltage sense amplifier and the temperature sense amplifier are directly applied to a summing circuit 24 in which a weighted sum is formed. Weighted sum in this context means that the individual values applied to said summing circuit 24 are multiplied by one device specific coefficient each. To circuit 24 a bias control element 26 is connected. This bias can also be sensed at a fixed resistor. For start correction, the signal NOT PRINT TIME, which indicates the print activity, is fed to the start correction control 21. In this circuit a charge storage element is discharged when no printing is effected and charged during printing. Discharging and charging are effected in accordance with a decaying exponential function. The term $\Delta A$ determined in this circuit is subsequently also weighted, i.e., multiplied by the factor $K_6$, in the summing circuit 24. By combining the various terms of this first equation, a control voltage is obtained which is applied to the voltage-controlled delay element 27. The timing pulse sensed at the type belt by the sense element 4 is fed to a trigger pulse amplifier 22, reaching as a trigger pulse also the voltage controlled delay element 27. In this delay element said trigger pulse is delayed as a function of the control voltage, so that the delayed trigger pulse is emitted at the output of said voltage-controlled delay element 27. In the present case it is assumed that a trigger pulse is initially sensed which subsequently, for synchronizing print hammer and print type during the printing of a character at a predetermined print position, is delayed to such an extent that a perfect print image is obtained. It is, of course, also possible to determine a center position and to shift the trigger pulse with a mean delay from that position in the direction of a lower as well as in the direction of a higher delay.

As explained in connection with FIG. 2, the setting to more than one copy can, in the form of an input signal, also be applied to a circuit for the form thickness. In this case the binary input signal for the form thickness is converted into an analogue signal. In addition, the output signal $\Delta V$ from the voltage sense amplifier 17 is applied to a further input of the form thickness circuit. On the output of the latter circuit the signal $\Delta V\Delta I$ is obtained by multiplication and fed to a further input of the circuit forming the weighted sum. Combination is subsequently effected in accordance with equation. (2). In this case, too, a control voltage is obtained from these input signals of the sense elements. This control voltage is fed to the voltage-controlled delay element 27 to correspondingly delay the trigger pulse. In accordance with FIG. 2, this delayed trigger pulse is fed to the print hammer control logic, causing in conjunction with the data and the print control a corresponding energization of one or several of the print hammers 8 for printing characters on the record carrier. The supply voltage 23 shown in FIG. 3 is provided for this part of the electronic equipment.

Figure 4:
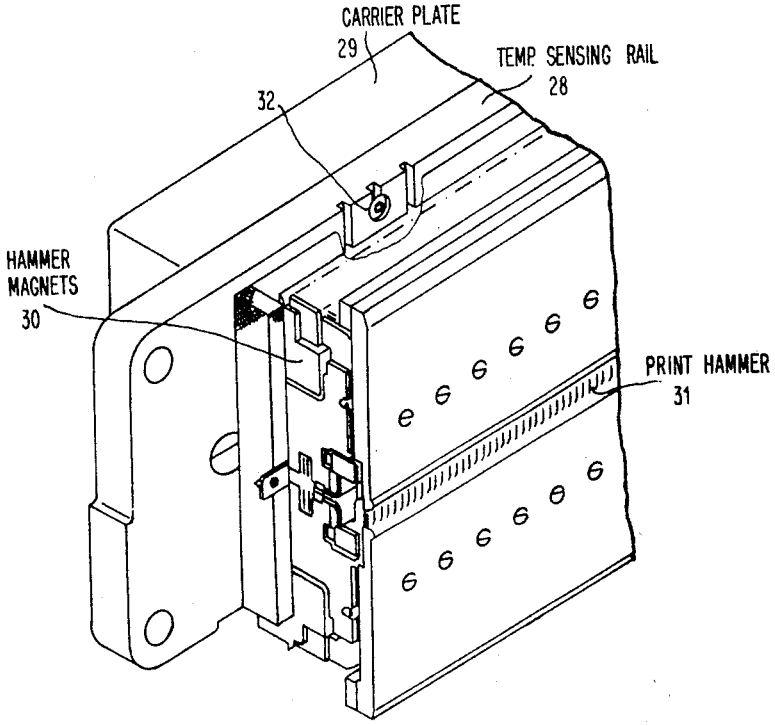
FIG. 4 is a schematic partial view of the temperature sensing bar.

FIG. 4 is a partial view of the print hammer arrangement. A temperature sense bar 28 is fixed to a solid carrier plate 29, supporting on its other side the print hammer magnets 30 which are arranged in two rows above each other. Also shown are two rows of print hammers 31. In the temperature sense bar 28 a transistor 32 sensing the temperature of the bar is fixed, electrically insulated, to a holder, sensing the bar temperature which is indicative of the average temperature of the various print hammer magnets. It has been found that this type of temperature determination constitutes a reasonable compromise, since the high thermal conductivity of the temperature sense bar ensures that the respective average temperature is obtained relatively rapidly. On the other hand, a certain delay is encountered as a result of heat being transferred from the print hammer magnets 30 to the temperature sense bar 28.

Figure 3:
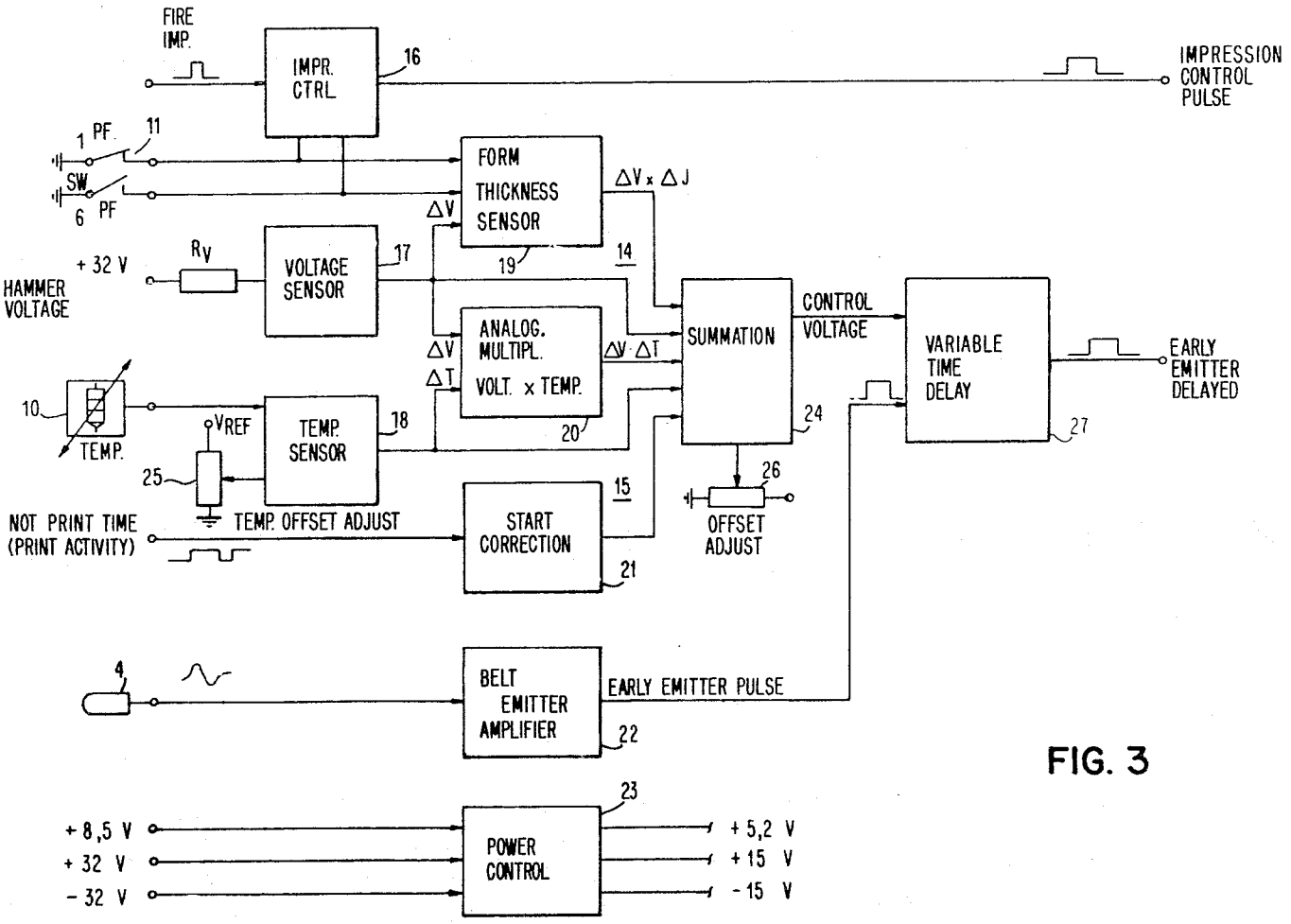
FIG. 3 is a block diagram explaining the invention in detail.
Figure 5:
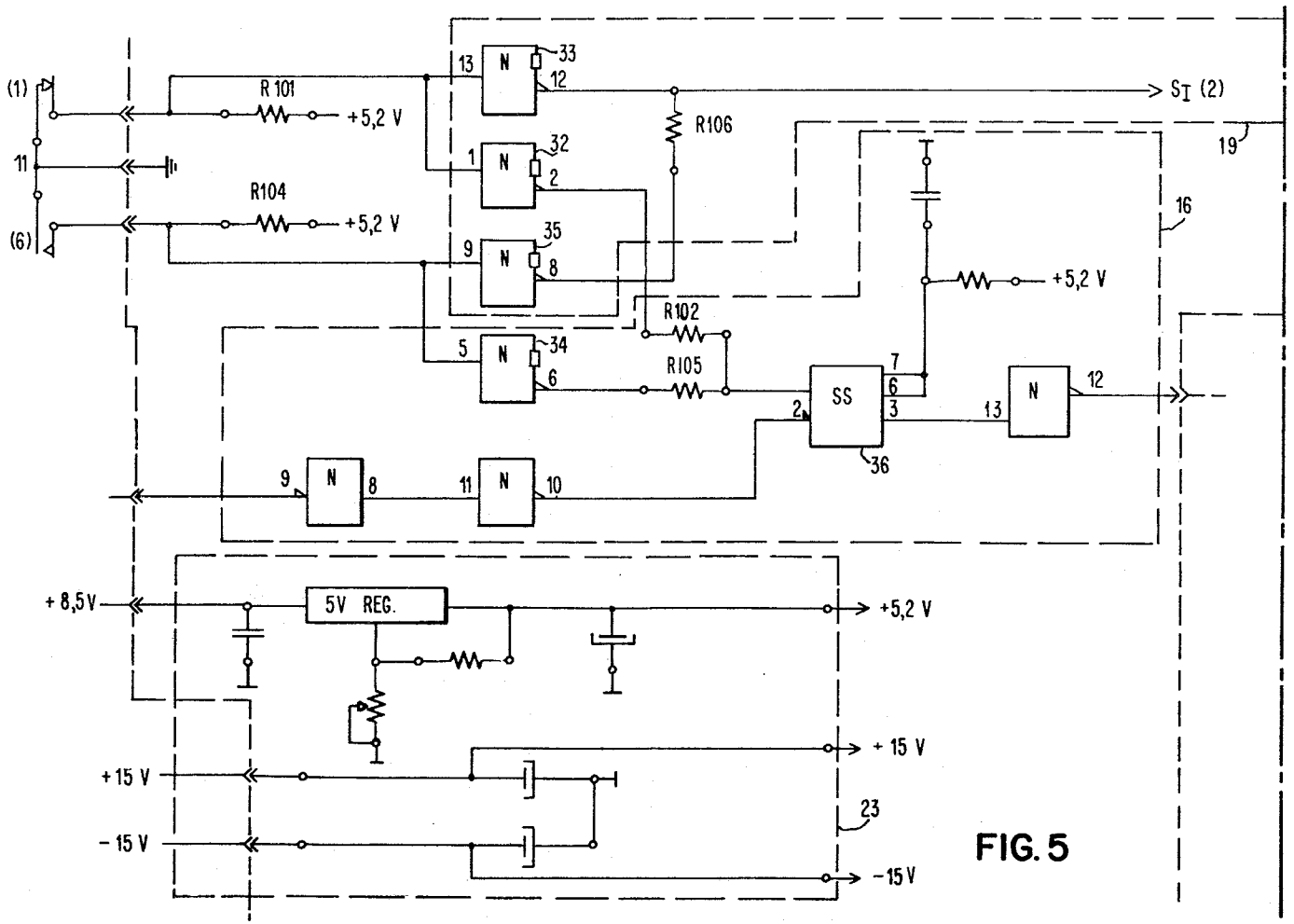
FIGS. 5–8 show details of the circuit blocks illustrated in FIG. 3.

FIGS. 5–8 show details of the circuit blocks illustrated in FIG. 3, whose functions will be described below by means of the former FIGURES in which the circuit groups provided with the reference numbers of FIG. 3 are surrounded by broken lines. The signal emitted by the sense element 11, represented in this case by two switches, is applied as a 2-bit signal, in the form of a voltage drop across the resistors R101 and/or R104, to the inverters 33, 35. Depending upon whether the potential corresponds to the value 0 or 1, either the output 12 or the output 8 of the inverter 33, or none of the outputs of said inverter, is grounded. Correspondingly, via the line $S_I$, one or both resistors are connected by means of R106 parallel to the node between R115 and R119 in FIG. 6, thus forming a resistor T network which, in turn, generates the input voltage for the operational amplifier 37. It may also be seen from FIG. 5 that the binary signal received from the sense element 11 is also applied to the impression force control 16 in FIG. 5. These signals are first fed to the inverters 32 and 34, determining, via resistors R102 and R105, respectively, the control voltage applied to the control input of a monostable multivibrator 36, to whose second input the control pulse is applied which also determines the impression force. Thus, depending upon the signal received from the sense element 11, the time constant of the monostable multivibrator 36 is changed, so that on the output side there is emitted either the original control pulse or a correspondingly prolonged control pulse. FIG. 5 also shows the controlled voltage supply 23 arranged on the control board proper and which need not be described in detail.

Figure 6:
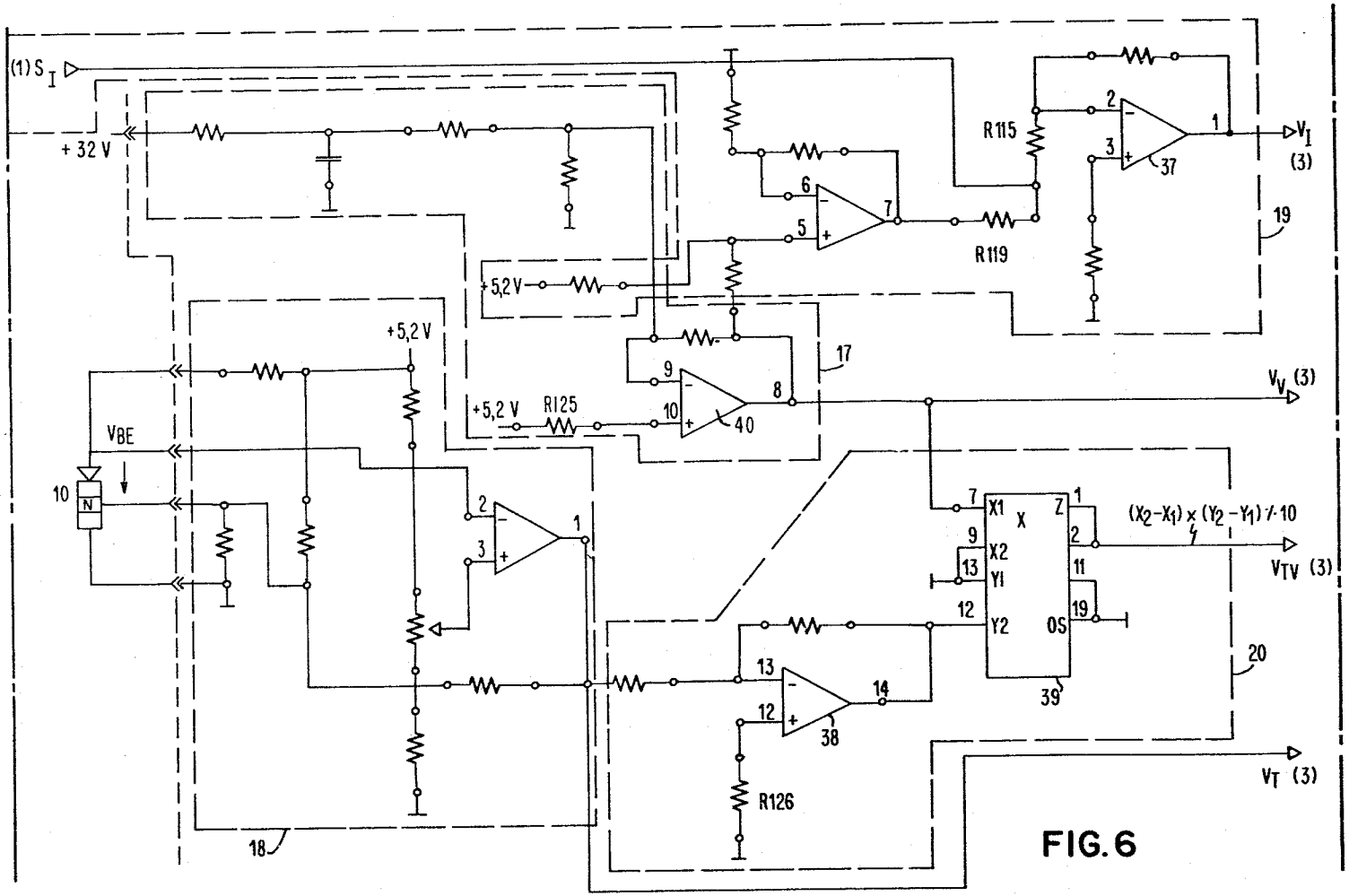

The temperature sense amplifier 18 shown in FIG. 6 receives its input signal from the temperature sensor 10, a heat-sensitive element, namely, a PNP transistor, inserted, electrically insulated, into the temperature sense bar 31. This voltage is fed to the negative input of a differential amplifier 37, to whose positive input a controllable compare voltage corresponding to a predetermined temperature is applied. The output signal $V_T$ of this differential amplifier is applied, as signal $\Delta T$ to the analogue multiplier circuit 20, on the one hand, and, on the other, via the inverting input of an operational amplifier 38, to the input of a multiplier circuit 39. The positive input of the operational amplifier 38 is grounded via R126. The output signal $\Delta V$ is applied to the X input of the multiplier circuit. This signal is received from the voltage sense amplifier 17 and is derived from the voltage applied to the inverting input of a differential amplifier 40. The non-inverting input of the differential amplifier 40 is connected to a positive potential of, for example, +5.2 volts via a resistor R125.

Subsequently, the signal $\Delta V \Delta T$ is obtained on the output of the multiplier circuit 39. The output signal $\Delta T$ of the temperature sense amplifier 18 together with the output signals of the form sense circuit 19 and the voltage sense circuit 17 is fed to the input of the summing circuit 24 shown in FIG. 7.

Figure 7:
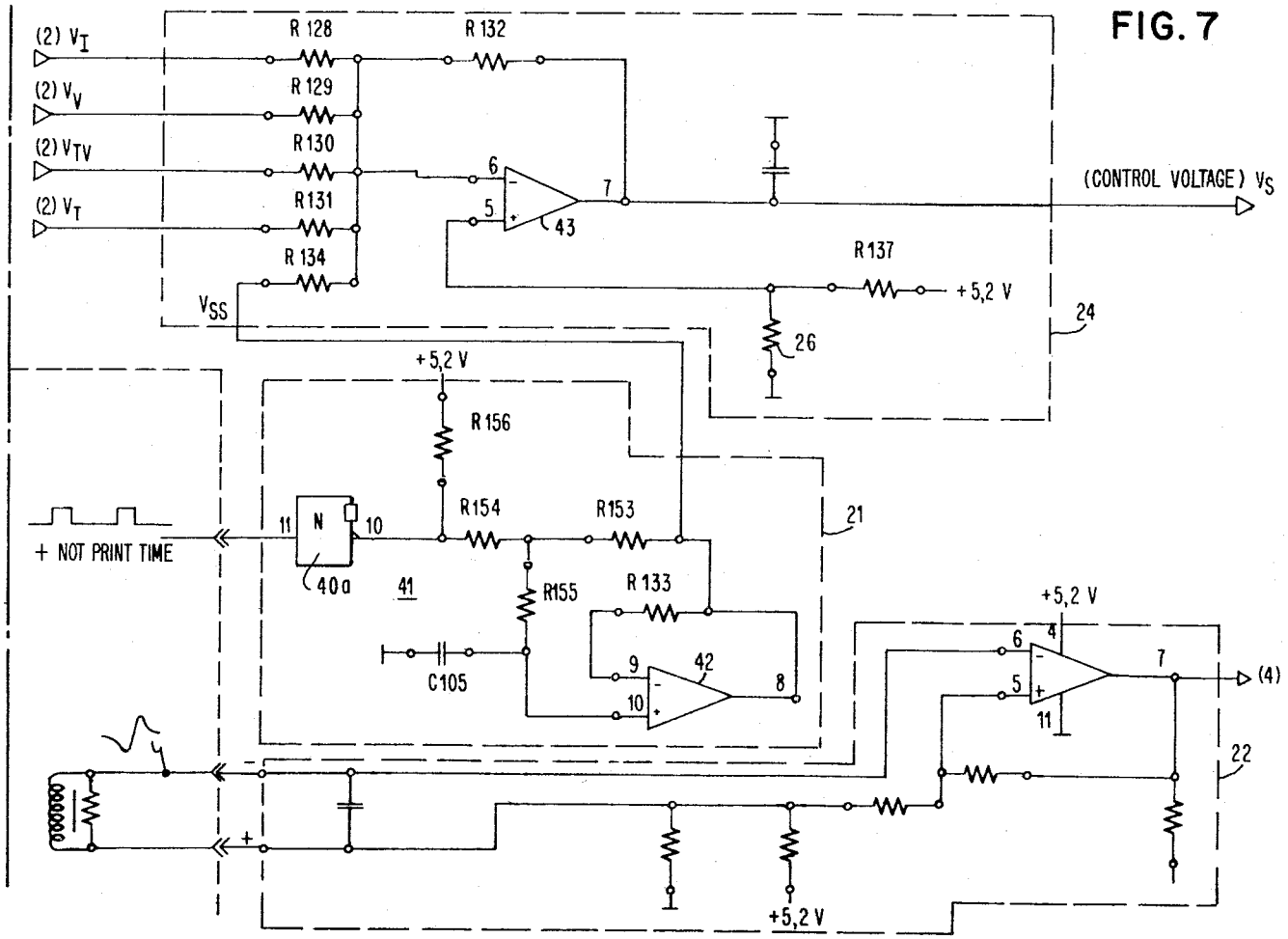

However, first of all attention is drawn to the start correction 21 of FIG. 7. The signal (print time) is fed, via an inverter 40A and a voltage divider 41 with the resistors R154, R155 and R156, to one terminal of a storage C105 and to the non-inverting input of a negative feedback operational amplifier 42, the inverting input of which is connected to the output of the operational amplifier 42 via a negative feedback resistor R133. This point is connected to the connecting point of the voltage divider resistors 154, 155 via a further resistor R153. The charge storage C105 is discharged during the signal (print time), i.e., when no printing is effected, and is charged during the signal (print time), i.e., when printing actually takes place. Discharging and charging are effected in accordance with a decaying e-function. For this purpose, the signal $\Delta A$, which is also applied to the input of the summing circuit 24, is available on the output of the respective stage. Thus, in the completed state, the signals $\Delta I$, $\Delta V$, $\Delta T$, $\Delta V \cdot \Delta T$, and $\Delta A$ are available on the input of said circuit 24. Weighting of the individual signal with the device specific co-efficients $K_1$–$K_6$ is effected via the value of the resistors R128, R129, R130, R131, R134 which are jointly connected to the inverting input of an operational amplifier 43, whose non-inverting input is connected to a bias of, for example, 5.2 volts and to ground via a further resistor 26 which may be adjustable. This voltage divider determines the bias on the non-inverting input. Via a negative feedback resistor R132, the output of the operational amplifier 43 is connected to the inverting input of the operational amplifier, on the output of which the control voltage $V_S$ subsequently occurs.

Figure 8:
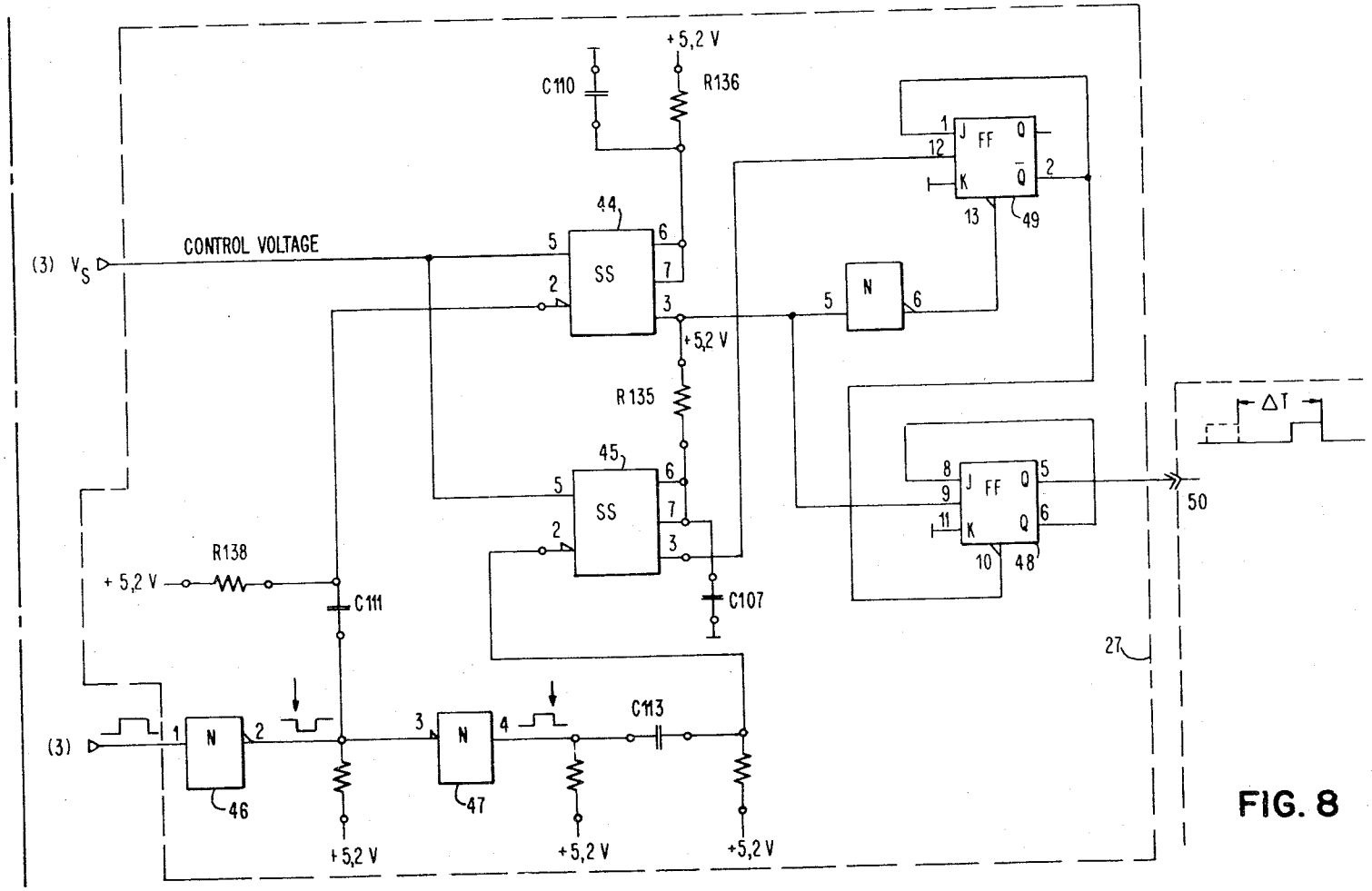

Finally, FIG. 8 shows the voltage-controlled delay element 27. The control voltage $V_S$ is initially fed to the control input of two monostable multivibrators 44 and 45. The trigger pulse received from the sense element 4, FIG. 3, is coupled to the biased second input of the multivibrator 44 via a first inverter stage 46. In addition, said signal, after having been inverted further, is coupled, by way of an inverter stage 47, to the biased second input of the multivibrator 45. Coupling is effected in each case via a coupling capacitor C111 and C113, respectively. The output signal of the first multivibrator 44 is applied to the control input of a bistable J-K multivibrator 48, whose $\overline{Q}$ output is connected to the J input, while the K input is grounded. Via an inverter, the output signal of the multivibrator 44 is also applied to the resetting input of a further bistable, latching J-K multivibrator 48, whose control input is connected to the output of the second monostable multivibrator 45, while its $\overline{Q}$ output is connected to the J input, and the K input is grounded. The $\overline{Q}$ output of the J-K multivibrator 49 is also connected to the resetting input of the bistable multivibrator 48.

The control voltage $V_S$ applied to the input of the voltage-controlled delay element 27 is an analogue voltage, the magnitude of which controls the time delay of the trigger pulse. For this purpose, this control voltage may change within certain limits the time constants of the monostable multivibrators 44 and 45, which are a function of the R-C elements C110, R136 and C107, R135, respectively, and thus the duration of the output pulses of said multivibrators.

The circuit operates as follows.

The trigger pulse sets the monostable multivibrator 44 by means of its leading edge. The trailing edge of said trigger pulse subsequently sets the monostable multivibrator 45. The output pulse of the multivibrator 44 initially resets the bistable multivibrator 49 via an inverter stage 50. The trailing edge of the output pulse of the multivibrator 44 sets the bistable multivibrator 48 on its control input. When the monostable multivibrator 45 resets, the trailing edge of the pulse causes the bistable multivibrator 49 to be set on its control input. As a result, an output signal resetting the bistable multivibrator 48 is generated on output $\overline{Q}$.

This shows that both the leading edge and the trailing edge of the output pulse emitted by the bistable multivibrator 48 are dependent upon the controllably delayed trailing edge of the output pulses of the monostable multivibrators 44 and 45, respectively. Thus, the trigger pulse is practically uniformly delayed as a function of the magnitude of the control voltage $V_S$.

As a result, a favourably priced design of print hammer unit and power supply is obtained, the energy consumption is reduced, and flexible adaptation to the different operating parameters is rendered possible, since by means of the circuit described, deviations of different operating parameters from their desired values may be compensated in a practicable manner.

Having thus described my invention, what I claim as new, and desire to secure by Letters Patent is:

1. A circuit arrangement for synchronizing the impact time of a plurality of magnet operated print hammers in an on-the-fly printer with the time of occurrence of a print type to be printed at a desired print position comprising a supply voltage, pulse generator means for supplying firing pulses to said hammers, control logic responsive to said firing pulses for operating said hammers, a voltage-controlled delay element interconnecting said pulse generator means to said control logic, means for detecting and determining deviations of operating parameters including said supply voltage to and the temperature of the magnets of said print hammers; and means for combining said values determined by said detecting and determining means with a dynamic exponentially dependent upon time control value to derive a control voltage in accordance with the relation $$\Delta DLY = K_1\Delta T + K_2\Delta T\cdot\Delta V + K_3\Delta V + K_6\Delta A$$

where $\Delta DLY$ is said control voltage $\Delta T$ is the temperature of the print hammer magnets $\Delta V$ is the voltage of the print hammer magnets $\Delta A$ is a value dependent upon the print activity, $K_1$, $K_2$, $K_3$, and $K_6$ are device specific coefficients, said derived control voltage being applied to said voltage-controlled delay element.

2. A circuit arrangement in accordance with claim 1, in which said means for detecting and determining deviations of operating parameters includes means for detecting the additional parameter of the number of copies to be made and for the determination of the impression force parameter required therefor, said additional parameters determined being combined in accordance with the relation $$\Delta DLY = K_1\Delta T + K_2\Delta T\cdot\Delta V + K_3\Delta V + K_4\Delta I + K_5\Delta V\cdot\Delta I + K_6\Delta A$$

where $\Delta I$ is the impact force.

3. A circuit arrangement in accordance with claim 1 which further includes a means to introduce the further parameters of the residual ripple or hum voltage of the voltage supply circuit of the print hammer magnets.

4. A circuit arrangement in accordance with claim 1 in which the temperature for all said print hammer magnets is jointly detected by said detection means.

5. A circuit arrangement in accordance with claim 4, in which there is provided a temperature sensor immediately adjacent the coils of said print hammer magnets for sensing the temperature of all print hammer magnets.

6. A circuit arrangement in accordance with claim 5, in which said temperature sensor is a temperature bar arranged immediately adjacent to all said print hammer magnet coils.

7. A circuit arrangement in accordance with claim 1 in which said detection means comprises a voltage sensor and temperature sensor connected to one sense amplifier each and to a summing circuit forming a weighted sum, and that further inputs are connected to the outputs of the two sense amplifiers and to a start correction circuit which, under the control of print activity signals (print time), supplies the dynamic correction term $K_6\Delta A$.

8. A circuit arrangement in accordance with claim 7 in which said start correction circuit, controllable by the print activity signal (print time), is provided with a charge storage which discharges during the periods in which no printing is effected and which is charged during printing in accordance with a decaying e-function, thereby supplying an indicator of the print activity.

9. A circuit arrangement in accordance with claim 2 in which a sense circuit is provided for the form thickness, to the inputs of which there are applied a signal indicating the number of copies and the output signal ($\Delta V$) of said voltage sense amplifier and the output side of which emits the product $\Delta V\cdot\Delta I$ directly to the summing circuit.

10. A circuit arrangement in accordance with claim 8 in which said voltage-controlled delay element is controlled by the output signal from said summing circuit and a trigger pulse derived from the print type carrier and emits on the output side a control voltage dependent, delayed trigger pulse to print control logic.

11. A circuit arrangement in accordance with claim 9 in which the form thickness sense elements supply a signal which is fed to an impression force control device on the one hand and on the other to said sense circuit for the form thickness.

12. A circuit arrangement in accordance with claim 11 in said sense circuit for the form thickness comprises a digital-to-analogue converter for the form thickness or the signal indicating the number of copies and is designed as an analogue multiplier stage, supplying the product $\Delta V\cdot\Delta I$.

* * * * *

UNITED STATES PATENT AND TRADEMARK OFFICE

CERTIFICATE OF CORRECTION

PATENT NO. : 4,259,903

DATED : April 7, 1981

INVENTOR(S) : K. Arendt et al

It is certified that error appears in the above-identified patent and that said Letters Patent are hereby corrected as shown below:

Column 3, lines 37 and 38, the formula should be corrected to read: $\Delta DLY=-K_1\Delta T+K_2\Delta T.\Delta V+L_3\Delta V+K_4\Delta I+K_5\Delta V.\Delta I-K_6\Delta A$ Column 9, line 53, the formula should be corrected to read: $\Delta DLY=-K_1\Delta T+K_2\Delta T.\Delta V+K_3\Delta V-K_6\Delta A$ Column 10, lines 4 and 5, formula should be corrected to read: $\Delta DLY=-K_1\Delta T+K_2\Delta T.\Delta V+K_3\Delta V+K_4\Delta I+K_5\Delta V.\Delta I-K_6\Delta A$ Signed and Sealed this

*Eighteenth* Day of *August 1981*

[SEAL]

*Attest:*

GERALD J. MOSSINGHOFF

*Attesting Officer*

*Commissioner of Patents and Trademarks*